US005717999A

United States Patent [19]

Lurry

[11] Patent Number: 5,717,999

[45] Date of Patent: Feb. 17, 1998

[54] MODULAR CLOTHING

[76] Inventor: Clay A. Lurry, 627 NE. 6th St., Apt. C, Blue Springs, Mo. 64014

[21] Appl. No.: 715,118

[22] Filed: Sep. 17, 1996

[51] Int. Cl.[6] ..... A41D 1/06

[52] U.S. Cl. ..... 2/69; 2/79; 2/108; 2/227; 2/244

[58] Field of Search ..... 2/69, 70, 75, 79, 2/80, 84, 102, 108, 126, 129, 227, 269, 244, 270, 271, 247, 251, 252, 912–914, 916, 919, 246, 239, 409

[56] References Cited

U.S. PATENT DOCUMENTS

| | | | |
|---|---|---|---|
| 1,489,046 | 1/1924 | Thompson | 2/70 |
| 1,833,163 | 11/1931 | Ischinger | 2/239 |
| 4,365,354 | 12/1982 | Sullivan | 2/247 |
| 4,390,996 | 7/1983 | Read . | |
| 4,554,682 | 11/1985 | Hillquist . | |
| 4,601,066 | 7/1986 | Campbell . | |
| 5,109,546 | 5/1992 | Dicker . | |
| 5,182,812 | 2/1993 | Goldsby | 2/79 |
| 5,359,734 | 11/1994 | Rathburn | 2/918 |

FOREIGN PATENT DOCUMENTS

| | | | |
|---|---|---|---|
| 567410 | 10/1957 | Italy | 2/920 |
| WO88/10074 | 12/1988 | WIPO | 2/69 |

*Primary Examiner*—Gloria Hale

*Attorney, Agent, or Firm*—Patent & Trademark Services; Joseph H. McGlynn

[57] ABSTRACT

An active wear garment which has sleeves, leggings, a collar, and a hood which are detachably connected to vest and pants portions. The components may be attached and detached to form outfits covering as much or as little of the body as desired. The sleeves are segmented to provide long and short sleeve configurations, and the leggings may be attached and detached to provide either long or short pants configurations. Zippers are provided down the length of the sleeves, leggings, and vest to provide ventilation and flexibility. The hood, cuffs, and pants portion may be provided with elastic or drawstring closures.

7 Claims, 2 Drawing Sheets

MODULAR CLOTHING

BACKGROUND OF THE INVENTION

The present invention relates generally to garments, and in particular to an active wear garment having detachable hood, sleeve, and pants portions.

DESCRIPTION OF THE PRIOR ART

There have been disclosed a number of garments which are intended to provide convenient and comfortable clothing for exercise and other activities. As described below, however, there remains a need for a garment which is more stylish and more adaptable to different types of activities.

U.S. Pat. No. 4,601,066 describes a garment having built-in warming wraps disposed at the extremity portions.

U.S. Pat. No. 4,390,996 discloses a garment having a trouser portion releasably attached to a jacket.

U.S. Pat. No. 4,554,682 describes a convertible jacket having a sleeveless vest that is detachably connected to an upper, sleeved component.

U.S. Pat. No. 5,109,546 discloses a resilient exercise suit having reinforced portions which give resistance to provide exercise.

In general, these and other inventions have not provided a garment which is adaptable to different types of weather and to different exercise activities. In particular, the prior art garments have not provided a clothing which can be conveniently and fashionably converted between various levels of covering, ranging from a full-body garment to a "shorts-and-T-shirt" configuration. The present invention provides such a garment, having both functional and aesthetic advantages over the prior art active-wear inventions.

SUMMARY OF THE INVENTION

The present invention is an improved garment, suitable for use in a variety of exercises and other activities. The invention comprises upper and lower body coverings having detachable hood, collar, sleeve, and leg portions. The components of the garment can be attached and detached to create an outfit most suited to the conditions of any particular activity.

The invention may be manufactured in a variety of fabrics, depending on the tastes of the wearer and the intended uses for the garment. The upper portion of the invention includes a sleeveless, vest-like component having attachment means at the neck, sleeve, and collar regions. The attachment means preferably consist of strips having both snap and hook-and-loop type closures. The upper portion also comprises sleeves, a hood, and a collar, each of which has an attachment strip with closures, providing a means to attach the components to the vest portion. The sleeves are further segmented, having upper and lower components detachably connected by the means described above. The sleeves may thus be converted between long and short sleeve versions, or else removed altogether.

The lower portion of the invention comprises a pants portion having detachably connected leggings. The pants portion preferably has an adjustable, drawstring-type waistband. The leggings further have zippered openings on the sides thereof, to provide ventilation and comfort.

The invention further has detachable design strips of various colorations, providing the wearer with a means to alter the look of the garment to fit individual tastes. In use, the invention provides a garment which is readily adaptable to a variety of uses and aesthetic configurations.

Accordingly, it is an object of the present invention to provide an improved garment.

It is a further object of this invention to provide a garment which is adaptable to suit different weather conditions, exercise activities, and individual tastes.

It is still further an object of this invention to provide a garment which is stylish, inexpensive, comfortable, and convenient.

It is still further an object of this invention to provide a garment having detachable sleeves, leggings, hood, and collar portions.

These and other objects and advantages of the present invention will become fully apparent from the detailed description below, when taken in conjunction with the annexed drawings.

DESCRIPTION OF THE PREFERRED EMBODIMENTS

Figure 1:
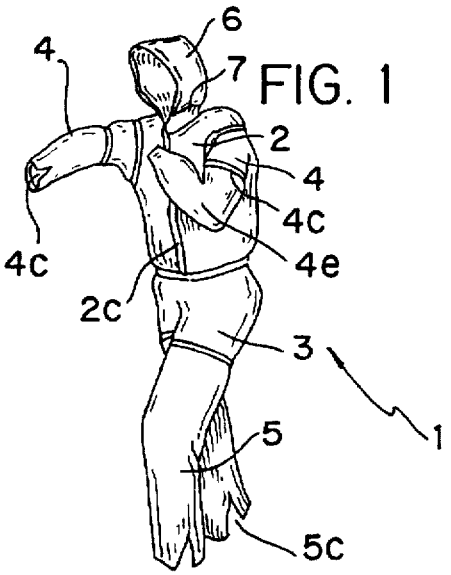
FIG. 1 shows a perspective view of the present invention having all the detachable components thereof attached together to form a full body covering.

Referring now to the drawings in greater detail, the garment of the present invention 1 may be seen in FIG. 1 comprising a vest 2, a lower pants portion 3, sleeves 4, leggings 5, a hood 6, and a collar 7. As shown in FIG. 1, the components of the invention 1 may be attached together to form a full body covering. As shown best in FIGS. 1, 2 and 3 taken together, the sleeves 4, hood 6, and collar 7 are detachably connected to the vest 2, and the leggings 5 are detachably connected to the pants portion 3. The sleeves 4 are also segmented at 4*c*, providing for short 4 and long 4*e* sleeve configurations. Thus, a variety of garment configurations may be created by attaching and detaching the various components of the invention 1 by the means described below.

Figure 3:
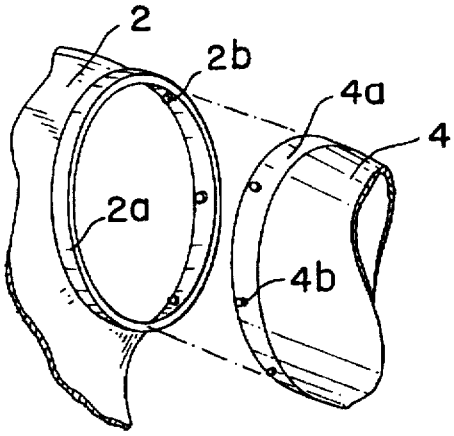
FIG. 3 is an enlarged, fragmentary view of the preferred sleeve attachment of the present invention.

As shown in FIG. 3 the arm opening of the vest 2 and the sleeve 4 each have fastening strips 2*a*, 4*a* sewn on the margins thereof. The fastening strips 2*a*, 4*a* preferably are constructed from hook-and-loop type closure material, more commonly known by the trademark VELCRO hook and loop fasteners. The fastening strips 2*a*, 4*a* may be sewn or otherwise securely fastened to the vest 2 and to the sleeve 4. The fastening steps 2*a*, 4*a* further have a plurality of snap fasteners 2*b*, 4*b* mounted thereon. As depicted by the directional lines in FIG. 3, the upper edge of the sleeve 4 is detachably connectable to the arm opening of the vest 2, the snap fasteners 2*b*, 4*b* and the fastening strips 2*a*, 4*a* coming together to form a seam between the sleeve 4 and the vest 2.

Figure 2:
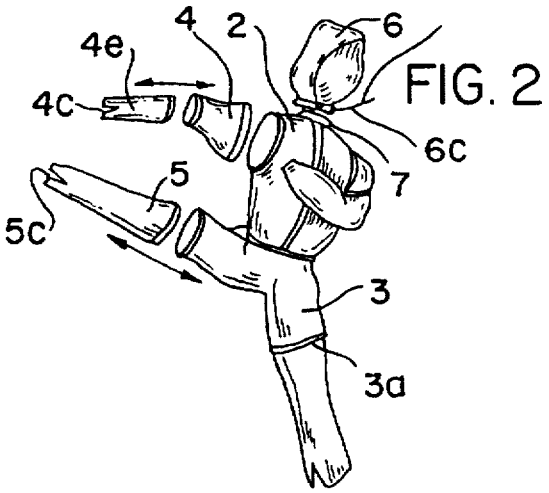
FIG. 2 a perspective view of the components of the present invention with some of the components detached.

The hood 6, collar 7, and leggings 5 are attached to the vest 2 and the pants 3 by the same means described immediately above. As shown in FIGS. 1, 2, and 3, taken together, each of these components 2–7 has disposed on the margin thereof a fastening strip constructed from hook-and-loop closure material. The fastening strips are also provided with snap fasteners identical to those described above. The hood 6 and collar 7 may thus be detachably connected at the head opening of the vest 2, and the leggings 5 may be similarly attached to the lower pants portion 3 at 3*a*.

As shown in FIGS. 1, 2, and 3, the leggings 5 and the sleeves 4 have zippered openings 4*c*, 5*c* extending partially down either side thereof. The zippered openings 4*c*, 5*c* provide a means to give ventilation and flexibility to the wearer's legs and arms. As shown in FIGS. 1, 2 and 3, the vest 2 also has a zippered opening 2*c* extending down the front thereof.

Figure 4:
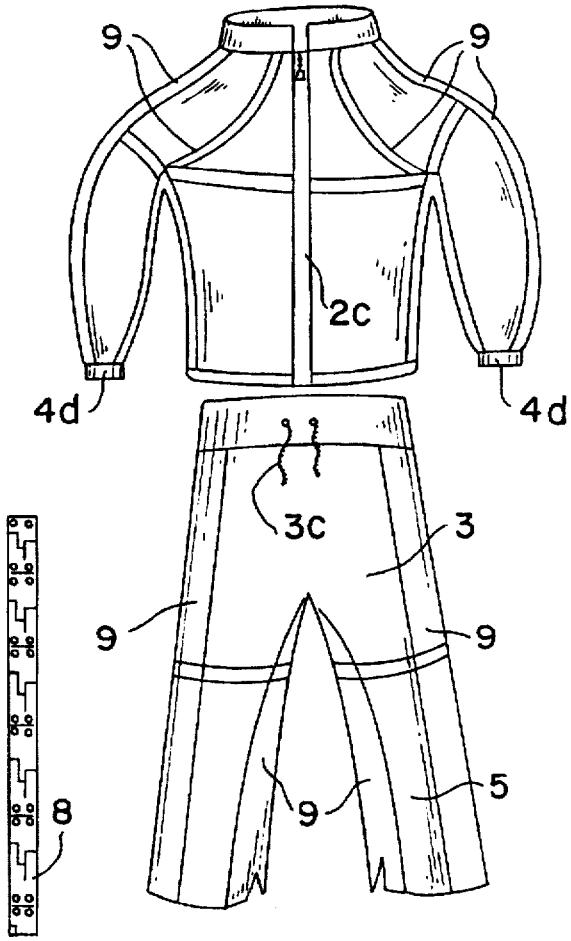
FIG. 4 is a plan view of the invention having detachable, decorative strips attached thereto.

As shown in FIGS. 2 and 4, the hood 6 and pants portion 3 are preferably provided with drawstring closures 3*c*, 6*c* for tightening the components to fit the particular wearer. As depicted in FIG. 4, the sleeves 4 preferably are provided with elastic cuffs 4*d*. Of course, the hood 6, pants 3, and sleeves 4 may be provided with either elastic openings or drawstring closures, and these or other adjustable closures may be used without departing from the scope of the invention.

Figure 5:
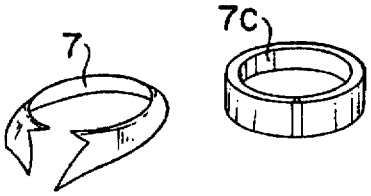
FIG. 5 is a view of two of the detachable collars that can be used with the present invention.

As shown in FIGS. 5, the collar 7 may be constructed as a standard, folding collar such as that seen on a dress shirt. It may also be constructed in a turtleneck version 7*c*. The turtleneck collar 7*c* would preferably be constructed from thick, flexible material capable of being rolled up and down.

FIG. 4 depicts the present invention having decorative stripes 8 (only one of which is shown) detachably connected to the vest 2, sleeves 4 and the leggings 5 at the areas designated 9 in FIG. 4. The stripes 8 are preferably connected by hook-and-loop closure means, but they may also be connected by snaps or other suitable means without departing from the scope of the invention. The stripes 8 could be variously colored, affording the wearer the ability to easily and quickly change the stylistic arrangement of the garment.

FIG. 5 depicts another embodiment of the present invention having decorative strips 8' (only one of which is shown) detachably connected to a jacket which has cuffs 4*d'* and detachable sleeves which detach at 2*a*. The strips can also be attached to the pants which have pockets 11 and have legs that are detachable at 3*a*. The stripes 8' are preferably connected by VELCRO hook-and-loop fastener means 14, but they may also be connected by snaps 12 or other suitable means without departing from the scope of the invention. The stripes 8' could be variously colored, affording the wearer the ability to easily and quickly change the stylistic arrangement of the garment.

Figure 6:
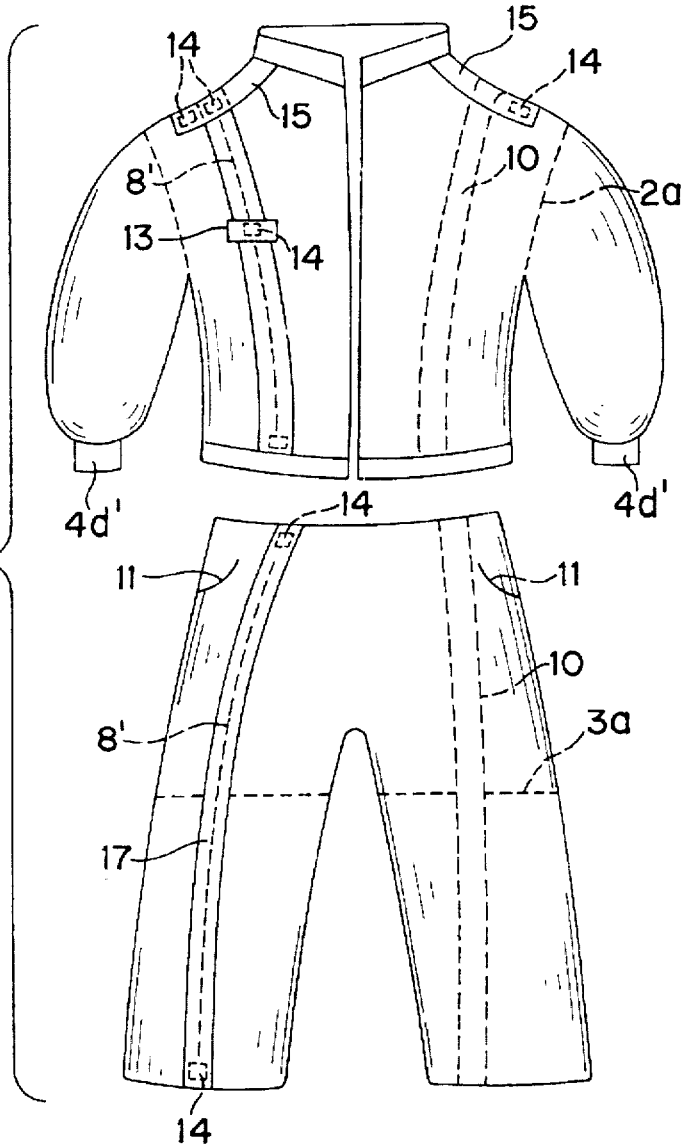
FIG. 6 is a plan view of another embodiment of the invention having detachable, decorative strips attached thereto.
Figure 7:
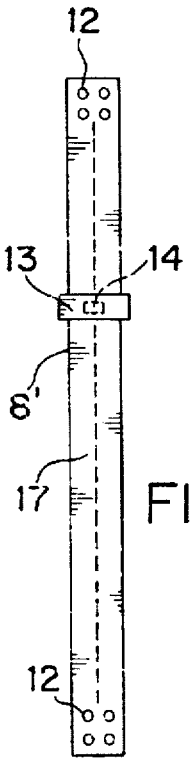
FIG. 7 is a plan view of one of the detachable, decorative strips.
Figure 8:
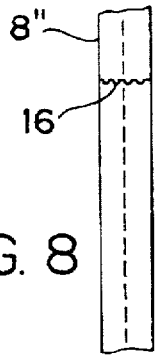
FIG. 8 is a partial plan view of another of the detachable, decorative strips.

In FIG. 6, only one stripe is shown, but the location of other stripes are shown by the dotted lines 10. Each stripe may be provided with an integral pocket 13 that may be closed by a flap or a zipper, which is shown on stripe 8" at 16 in FIG. 8.

As shown in FIG. 6, the stripes on the jacket are positioned under epaulets 15 which are secured to the jacket by fastening means such as, but not limited to, VELCRO hook and loop fasteners 14. The epaulets 15 will help to secure the stripes 8' to the jacket.

The components of the invention 1 may be made from a variety of fabrics using traditional cut and sew techniques. A thicker, waterproof material may be preferable for winter activities, whereas a thinner, more ventilated fabric would be preferable for summer activities. The invention may be constructed inexpensively by using a "serger" or "overlock" machine, which can stitch seams, trim excess fabric, and overcast raw edges in one operation.

The article's construction also requires the use of numerous stitching processes. A few of these methods and techniques are commonplace and easily understood by all. Easestitching is a technique used to join a longer fabric edge to a slightly shorter one. This technique is similar to the type used for gathering, but there should be no folds or gathers visible on the outside of the article once the seam is stitched. Edgestitching is a technique forming an extra row of regulation-length stitches appearing on the outside of a bag. It is placed approximately ⅛" (3 mm) or less away from a seam-line or a fold-line, or close to a finished edge. This type of stitch is similar to a topstitch but is less noticeable because it is closer to the edge and is always performed in matching thread.

Reinforcement stitching is a technique for strengthening the stitching areas that will be closely trimmed, such as corners or along deep curves that will be clipped or notched at frequent intervals. The basic premise is that a shorter stitch length is used.

Staystitching is a line of regulation stitching preventing curved or bias edges, such as necklines, shoulders and waistlines, from stretching out of shape as they are handled. Staystitching requires a regulation length stitch of one half inch from the cut edge of the fabric.

Stitch-in-the-ditch is a technique which allows a quick way to hold layers of fabric in place at the seams. It is an effective way to secure neckline, armhole, or waistband facing as well as fold up cuffs.

Topstitching is a technique forming an extra row of stitching on the outside of the bag along or near a finished edge. Although topstitching is usually added as decoration, it can also be functional. Understitching is a technique forming a row of stitching which prevents an inside layer of fabric, usually a facing, from rolling to the outside of the bad.

Understitching is performed after the seam allowances are trimmed, graded and clipped or notched.

Seams are the backbone of a finished manufactured product. A seam is basically a line of stitching that joins two or more layers of fabric. Seams are stitched on the seam line. The seam allowance is the distance between the seam line and the cut edge. There are several types of seams. The Double-Stitch Seam is a combination seam and edge finish that creates a narrow seam especially good for sheer fabrics and knits. This seam prevents the fabric from raveling and is stitched twice.

A Plain Seam consists of right sides together, stitched along the seam line, which is usually ⅝" from the cut edge, with a regulation length stitch.

Stretch knits need seams that are supple enough to give with the fabric. These fabrics may be manufactured with straight stitches, zig zag stitches or one of the stretch stitches which are found in many factories.

Flat-Felled Seams are frequently used on sportswear, men's wear and reversible bags. These seams are accomplished by bringing wrong sides of the fabric together and stitching a plain seam, pressing the seam allowances to one side.

The French Seam adds a contour look to the inside of bags made from sheers and lightweight silks. The finished seam which is very narrow, completely encloses the raw edges of the seam allowances.

Lapped seams are frequently used on non-woven fabrics, such as synthetic suede and leather, as well as real suede and leather, because their edges do not fray.

Topstitched Seams accent seam lines. They also help keep the seam allowances flat—a great benefit when working with crease resistant fabrics.

Welt Seams are a good way to reduce bulk and hold seam allowances flat on heavyweight fabrics. From the outside, it looks like a topstitched seam; the double-welt version looks like a flat-felled seam.

There are three basic styles of sleeves-set-in, i.e. kimono and raglan. The set-in sleeve provides the smoothest fitting sleeve, one without dimples or tucks along the seam of the sleeve cap. The one thing that separates the set-in sleeve from the others is the fact that the sleeve itself is slightly larger than the armhole of the garment.

Kimono sleeves are formed as part of the garment front and back. This sleeve is the easiest to make since there is nothing to deal with but an underarm sleeve.

Raglan sleeves are joined to the garment front and back by diagonal seams which run from the underarm to the neckline In use, the present invention 1 provides a versatile, comfortable, stylish and convenient garment which is suitable for many different types of activities and weather conditions. The components of the invention may be attached and detached to create outfits which cover as much or as little of the body as desired.

Although the garment and the method of using the same according to the present invention has been described in the foregoing specification with considerable details, it is to be understood that modifications may be made to the present invention which do not exceed the scope of the appended claims and modified forms of this invention done by others skilled in the art to which the invention pertains will be considered infringements of this invention when those modified forms fall within the claimed scope of the invention.

What I claim as my invention is:

1. An article of clothing comprising:

a jacket part and a pants part, said jacket part having a body part adapted to be worn around a person's upper torso, and having fastening means for securing said jacket part about a person, said jacket part having at least one sleeve, each said sleeve composed of an upper part detachably secured to said jacket part, and a lower part detachably secured to said upper part, said jacket part having a neck area positioned near an upper portion of said jacket part, a collar secured to said neck area, a hood detachably secured to said collar, said pants part composed of an upper portion having detachable leg portions, each detachable leg portion having a slit at a lower part thereof, said slit having fastening means for closing said slit, and wherein said jacket part and pants part have areas where decorative strips can be detachably secured, and means for fastening said decorative strips, whereby said decorative strips can be changed to alter the appearance of said jacket part and pants part, and wherein said jacket part has a strip of material attached to a shoulder area of said jacket, said shoulder strip having two ends, with at least one of said ends being detachable, said decorative strip extending beneath said shoulder strip.

2. The article of clothing as claimed in claim 1, wherein said collar is a part circular element with pointed portions at each end.

3. The article of clothing as claimed in claim 1, wherein said collar is a circular element.

4. The article of clothing as claimed in claim 1, wherein said fastening means is hook and loop fasteners with snaps secured at intervals therealong.

5. The article of clothing as claimed in claim 1, wherein said jacket part and pants part have areas where decorative strips can be detachably secured, and means for fastening said decorative strips, whereby said decorative strips can be changed to alter the appearance of said jacket part and pants part.

6. The article of clothing as claimed in claim 5, wherein said decorative strips have pockets formed therein.

7. The article of clothing as claimed in claim 6, wherein said pockets have means for closing said pockets.

* * * * *